US005714722A

United States Patent [19]

Noponen

[11] Patent Number: 5,714,722

[45] Date of Patent: Feb. 3, 1998

[54] LOUDSPEAKER

[75] Inventor: Seppo Noponen, Ainastalo, Finland

[73] Assignee: Transducer Valley, Inc., Ainastalo, Finland

[21] Appl. No.: 244,308

[22] PCT Filed: Nov. 24, 1992

[86] PCT No.: PCT/FI92/00314

§ 371 Date: May 25, 1994

§ 102(e) Date: May 25, 1994

[87] PCT Pub. No.: WO93/11649

PCT Pub. Date: Jun. 10, 1993

[30] Foreign Application Priority Data

Nov. 25, 1991 [FI] Finland ..... 915525

[51] Int. Cl.[6] ..... G10K 13/00

[52] U.S. Cl. ..... 181/173; 181/174; 181/166; 181/171; 381/203

[58] Field of Search ..... 181/164, 165, 181/166, 167, 171, 173, 174; 381/202, 203

[56] References Cited

U.S. PATENT DOCUMENTS

| | | | |
|---|---|---|---|
| 1,815,944 | 7/1931 | Gumaer | 181/174 |
| 1,863,072 | 6/1932 | Smythe | 181/164 |
| 3,534,827 | 10/1970 | Heidrich | 181/166 |
| 3,586,121 | 6/1971 | Sotome | 181/167 |
| 3,708,035 | 1/1973 | Sotome | 181/174 X |

OTHER PUBLICATIONS

Patent Abstracts of Japan, vol. 15, No. 506, E-1148, abstract of JP, A, 3-220897 (Matsushita Electric Ind Co Ltd), 30 Sep. 1991.

*Primary Examiner*—Khanh Dang
*Attorney, Agent, or Firm*—Pollock, Vande Sande & Priddy

[57] ABSTRACT

The present invention provides a loudspeaker including a case having an inner wall, a front opening, and an edge surrounding the front opening. A diaphragm including a substantially planar front surface, a rear surface, and a periphery is attached to the case with flexible attachment element(s). The attaching means attaches the periphery of the diaphragm to the case in the vicinity of the edge of the front opening. A controller is attached to the case in the vicinity of a central inside portion of the case. An actuator is attached to the diaphragm in the vicinity of a central portion of the diaphragm. The controller and the actuator transform an electric signal provided to the controller into a corresponding vibratory movement of the diaphragm between a high frequency and a low frequency. The diaphragm includes a first area in the vicinity of where the actuator is attached to the diaphragm. The diaphragm also includes a second area between the first area and the periphery of the diaphragm. The first area is lighter weight and more elastic or flexible than the second area to make the diaphragm capable of sensitively vibrating only in the first area at frequencies in the vicinity of the high frequency and to make the first area capable of transmitting to the second area vibratory movement of the actuator in the vicinity of the low frequency.

15 Claims, 1 Drawing Sheet

LOUDSPEAKER

FIELD OF THE INVENTION

The invention relates to a loudspeaker.

BACKGROUND OF THE INVENTION

It is common for the diaphragm of loudspeaker element to consist, for example, of a stiff cardboard cone. An outer edge of the diaphragm is flexibly attached to a framework of the element. A voice coil, moving in a magnetic field, is fixed in the center of the cone. Currently, the conical diaphragm is frequently manufactured of plastic, fiber or even aluminum. The suspension of the cone is realized by corrugations on its external edge or a rubber molding glued to that edge and by a flexible support, or 'spider' attached to the voice coil. A conical loudspeaker can produce distortion caused by buckling strains arising in the diaphragm and by pressure foci.

There are also designs that employ a planar diaphragm attached to the edge of the loudspeaker casing. Such a design is presented in U.S. Pat. No. 3,509,290. The planar diaphragm is manufactured of expanded polystyrene or some other comparable plastic material. The diaphragm then has a number of controllers connected with it, each for its own frequency range. The controller in the center of the diaphragm typically produces the bass frequencies and one, at the edge, the higher frequencies. The disadvantage of this design is that several controllers have to be used for different sound frequency ranges. Also, with this design, a distribution filter must be used to divide the incoming signal between the controllers. The use of a number of controllers with one diaphragm causes mixing between them. The missing is manifested in distortion.

U.S. Pat. No. 3,586,121 shows a loudspeaker diaphragm that is thinner at the center than in the surrounding areas. This diaphragm has a front surface that is essentially of the form of a truncated cone. The controller is attached to the central area of the diaphragm. The diaphragm is manufactured of a foamed plastic such as polystyrene and is typically 2–3 mm thick at the center and varies in the range 3–7 mm in the surrounding areas. The purpose of the attenuated concave area on the front surface is to improve the poor sound reproduction at high frequencies known to be experienced with planar diaphragms made of a foamed plastic. The drawback with this loudspeaker is that the truncated cone of the front surface behaves essentially in the same manner as a conical loudspeaker.

U.S. Pat. No. 1,863,072 discloses a loudspeaker diaphragm that possesses a circular center part and a first annular part, which is joined to the edge of the circular part. A second annular part is joined to the outer edge of the first annular part. The second annular part is fixed to the casing by its outer edge. The three parts are made of different metal and have different thicknesses.

U.S. Pat. No. 3,534,827 discloses a loudspeaker casing comprising an inner and an outer chamber as well as a duct communicating with the chambers.

Japanese patent publication 3 220 897 (Patent Abstracts of Japan, vol. 15, no. 506, E-1148) discloses a ventilation arrangement for allowing air flow in and out of the voice coil.

SUMMARY OF THE INVENTION

The aim of the present innovation is to produce a loudspeaker with a satisfactory frequency response over the whole voice frequency range of 16 Hz–22,000 Hz, with a considerably higher power transfer ratio than in known existing speakers and with minimal distortion components in the sound produced.

The loudspeaker according to the invention is such that the planar structure of the front surface of the diaphragm generates such a vibrating diaphragm wherein the diaphragm forms essentially a spherical surface. The sound issuing from such a front surface is evenly distributed and free of the distortions referred to above. The loudspeaker has only one controller and no distribution filter is required.

According to one advantageous embodiment of the invention the loudspeaker casing is compartmentalized into a system of chambers that dampen the vibration of the diaphragm. This regulates air flows inside the casing and thereby affects the vibration of the diaphragm. Air flows inside the casing are reduced in magnitude as the frequencies concerned become higher. The purpose of this chamber system is to cause both the flow of air and the advancing wave front to disperse so that they will not cause a constant response in the form of background beats that recur at given points in time. The principle is that at low frequencies, when the diaphragm is moving slowly, air has time to flow over the whole area of the rear surface of the diaphragm, whereas at high frequencies a substantial flow is obtained only at the center of the diaphragm. Thus, the remaining part will not be set in motion and the sound generating surface will be confined to the center. Conversely, the whole surface will be involved when low frequency sounds are produced.

BRIEF DESCRIPTION OF THE DRAWINGS

The following detailed description of an embodiment of the loudspeaker according to the invention refers to the accompanying drawings, in which.

DETAILED DESCRIPTION OF THE INVENTION

Figure 1:
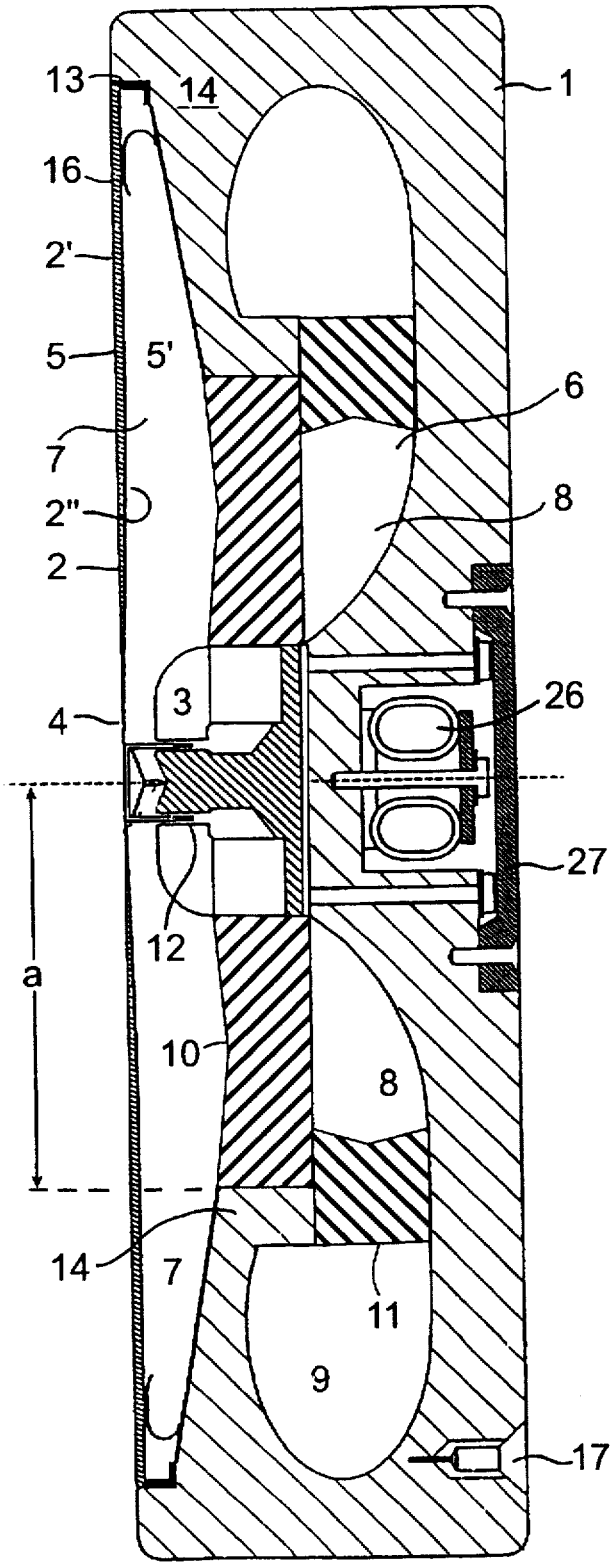
FIG. 1 represents a cross-sectional view of an embodiment of a loudspeaker according to the present invention.

As seen in FIG. 1, the loudspeaker comprises the casing 1, the diaphragm 2, which is attached to the casing 1 by its edges, and the controller 3, connected to the diaphragm 2. The diaphragm 2 is attached to the edge of the loudspeaker casing 1 the flexible seal ring 13, which acts as the diaphragm suspender. This seal ring is capable of flexion both in the direction of the diaphragm 2 and perpendicular to the diaphragm 2. However, the seal ring always flexes with the diaphragm 2 remaining firmly fixed to the loudspeaker casing 1. In order to promote a bending action in a direction perpendicular to the diaphragm 2, a thin grooved point is provided at the point where the seal ring reaches the diaphragm 2. Alternatively, flexible attachment of the diaphragm to its suspender is ensured in some other way. The loudspeaker casing 1 is essentially closed, containing at most a small hole or air vent. The hole or vent is largely intended to even out variations in external air pressure. The loudspeaker casing 1 can be fashioned from fine grained, accurately workable chipboard, known by the trade name MDF Board. The loudspeaker casing can also be manufactured by molding or casting, or by sawing from boards. The loudspeaker casing can be of wood, glass fiber or plastic, or of a sandwich construction of wood or fiber board, or the like, glued on top of each other. The loudspeaker casing 1 can be thin in shape, as in FIG. 1, in which case the thickness of the loudspeaker in a direction normal to the diaphragm 2 is substantially less than its length in a direction parallel to the diaphragm 2.

The front surface 2' of the diaphragm 2, that is, the surface facing the listener, is a plane. The diaphragm 2 should, in principle, move in the manner of the surface of a sphere at all frequencies, separately. This is because no other form of surface will emit evenly disseminating waveforms towards the listener. On the other hand, the front surface 2' of the diaphragm 2 must also be sufficiently rigid that an impact sound will set the whole diaphragm in motion. Therefore, the diaphragm 2 must not "give" too much. At the same time, however, the diaphragm 2 should have as low a radial flexural rigidity as possible, so that the power from the voice coil 12 that sets the diaphragm 2 in motion will achieve as great a deflection as possible.

Figure 3:
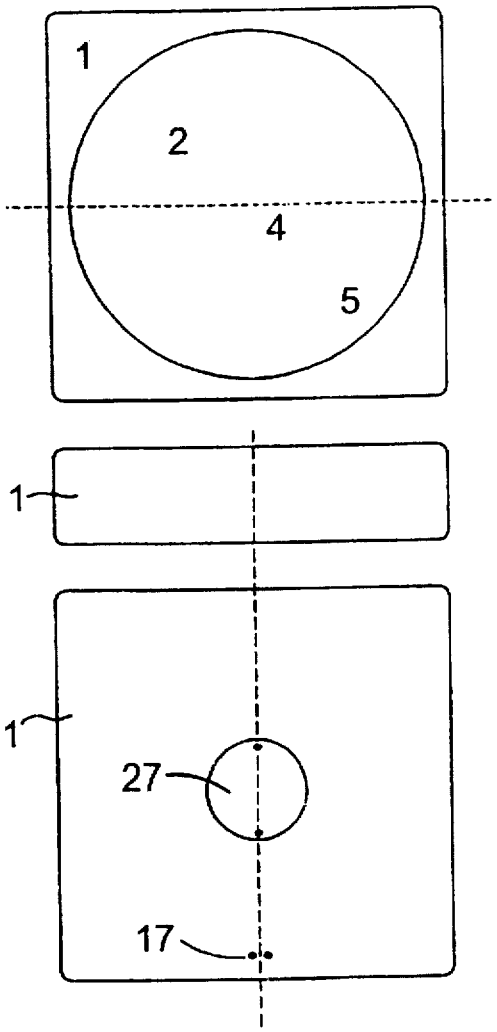
FIG. 3 represents three schematic views of an embodiment of a the loudspeaker according to the present invention.

The diaphragm 2 comprises the first area 4, to which the voice coil 12 of the controller 3 is attached. This first area 4 is such that it is more elastic and/or flexible than the second area 5 located beyond it. Then the motion of the controller 3 is converted into motion of the second area 5 through the mediation of the first area 4. In the case illustrated in FIG. 1, elasticity is achieved in the first area 4 by ensuring that this is thinner than the second area 5. It is advantageous to arrange the areas so that the center part of the diaphragm 2 forms the first area 4 and the periphery of the diaphragm 2 surrounding the central area 4 forms the second area 5. The diaphragm is most conveniently a rigid unit manufactured of carbon fiber, for instance. It can also be manufactured of a nonelastic thermosetting plastic such as PVC or acrylic, which can easily be processed to the desired shape. Other possible diaphragm materials would be metals, such as sheet steel, or wooden board, such as plywood. The diaphragm 2 in FIGS. 1 and 3 is circular in shape and its central area 4 is more flexible than its other parts. This is achieved by making the central part of its rear surface 2" thinner and arranging for the thickness of the diaphragm 2 to increase outwards radially from the central area 4 towards the periphery 5. A suitable diameter for the diaphragm would be 10–50 cm and a suitable thickness 0.1–1.5 mm. The planar diaphragm 2 is disc-shaped, light in structure but still suitably rigid and sufficiently flexible. It can also be of a cellular structure in a transverse cross-section relative to its radius and of a carbon fiber construction. The most essential point about its structure, however, is that it must increase in either mass or rigidity as a function of radius, so that the capacity of the diaphragm to perform high-frequency vibrations diminishes outwards from the central area 4 towards the periphery 5. If the radius of a circular diaphragm is 20 cm, for instance, one possible thickness profile could be the following. The thinnest point of the diaphragm would extend about 1–2 cm outwards from the edge of the voice coil 12. The voice coil has a diameter about 2 cm and is glued to the center point of the diaphragm. From this distance onwards the thickness of the diaphragm increases, to reach is full value about 7–8 cm away from the center point. From this point onwards the diaphragm is essentially of even thickness. The diaphragm 2 may also be elliptical in shape, in which case the chamber inside the loudspeaker casing 1 will also be essentially elliptical. An elliptical diaphragm constitutes an economical means of achieving a broader sound wave segment in a room.

The voice coil 12 of the controller 3 is connected to the diaphragm 2 in its central area 4. The central area 4 of the diaphragm 2 must be very light but sufficiently rigid that it does not set up secondary vibrations at any frequency. The diaphragm 2 can also have an air hole at its center, allowing free equalization of the chamber pressure. The size of this hole should be selected carefully, however, and should be small relative to the wavelength of even the highest frequencies to be reproduced.

The voice coil 12 is attached to the diaphragm 2 with a self-adhesive pad, glue, hot-setting adhesive or even a screw. The voice coil can be connected with the diaphragm 2 using some other appropriate connector. The voice coil 12 is typically a cylindrical solenoid of diameter about 20 mm, to which the terminal power of the sound frequency amplifier is usually connected directly. The core of the voice coil can be cast in the same material as the diaphragm, for example, and even simultaneously, so that it forms part of the same unit. The voice coil 12 can be made of aluminum wire, to reduce its mass. If the resistance is kept the same, the volume of the wire will increase. This effect can be exploited to improve the structural rigidity of the coil. This means that the voice coil does not necessarily require a separate spool. The wire can be of square or octagonal cross-section. This will cause a small increase in resistance of about 30%, but as the weight of the coil is reduced by 70%, a considerable improvement in treble-range reproduction is achieved. This has the same effect as a reduction in the weight of the central part of the diaphragm.

Power can be supplied to the voice coil 12 via extremely thin foil connectors glued or vaporized onto the rear surface 2" of the diaphragm. Power is fed to the foliated leads via the spring contacts 16, for example. The power input to the loudspeaker as a whole is fed via the connector 17. The voice coil 12 moves within a maximally homogeneous magnetic field implemented by means of a permanent magnet, for example. The voice coil 12 typically performs displacements of +3 mm, at the most. As shown in FIG. 1, the permanent magnet is brought as close as possible to the diaphragm.

Figure 2:
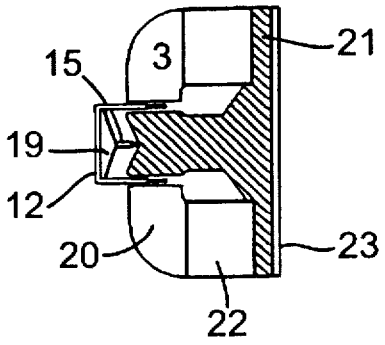
FIG. 2 represents a cross-sectional view of the structure of the controller of the loudspeaker.

The structure of a typical magnetic controller 3 is shown in FIG. 2. The connection for the cylindrical voice coil 12 with the diaphragm also comprises a rigidity element 19 that prevents the end piece from resonating at high frequencies. The elongated holes 15 run through the structure. The magnetic component 21 in the magnetic circuit of the controller 3 can conveniently be part of the same piece. Its counterpart 20 is shaped so as to render the magnetic field at the air hole as homogeneous as possible. The attachment screws of the flexible base 23 and the controller 3 can be adjusted for accurate orientation of the controller so as to ensure that the voice coil 12 is located symmetrically in the air space of the magnet. The circular S pole of the permanent magnet, which consists of the magnetic component 21 mentioned above, is located inside the moving voice coil 12. Air holes 15 are arranged in the voice coil to ensure a free flow of air inside and out from the voice coil 12 without this air flow interfering with the motion of the voice coil 12. The N pole of the permanent magnet of the controller 3, which is located around the S pole mentioned above, may consist of the annular piece 20, fashioned of soft iron, to which the magnetic part 22 (e.g. Feroxdure) that produces the magnetic flux is attached. The controller 3 is fixed to the controller base of the loudspeaker casing 1 by means of the flexible base 23 in such a manner that the relative positions of the voice coil 12 and the controller 3 can be adjusted precisely with three screws, for example.

Instead of the above electromagnetic principle, the controller 3 can function on a capacitative, piezoelectric or magnetostrictive principle. The loudspeaker may incorporate a supply transformer 26, located in a space under the lid 27. Apart from impedance matching, this transformer 26 will also level out reproduction between the various frequency ranges.

The chamber system 6 on the rear surface 2" of the diaphragm 2 should be made sufficiently large that the volumetric change brought about by the movement of the diaphragm does not essentially influence the static air pressure in the chamber. Otherwise, if the change in static air pressure is significant, more than 10%, the pressure excesses and deficiencies at different halfcycles will cause non-linearity in the form of the resulting acoustic half-waves.

The sensitivity of the diaphragm 2 to movement is determined by the amount of air in contact with the rear surface 2" of the diaphragm 2. However, a large volume of air in the loudspeaker casing 1 will increase motional sensitivity. Motional sensitivity is also a function of frequency relative to the background air behind the diaphragm.

The amount of air in contact with the rear surface 2" of the diaphragm 2 is adjusted in the loudspeaker according to the invention by means of a special chamber system 6. The chamber system 6 influences the state of movement of the various parts of the diaphragm in the desired manner. This chamber system 6 and its associated structures are implemented in such a manner as to ensure that the various areas of the diaphragm respond in the desired manner.

The chamber system 6 consists of three chamber areas divided from each other by the dampers 10 and 11. The first, or front chamber 7, occurs directly behind the diaphragm. The front chamber is delimited by the projection 14, which extends from the edges of the loudspeaker casing 1 opposite the diaphragm 2, to the central area 4 and the first damper 10, located between this projection 14 and the controller 3. The wall of the controller 3 bordering the front chamber 7 may have a curved shape. On the other side of the damper 10 is the middle chamber 8. The middle chamber 8 is then separated by the second damper 11 from the rearmost chamber, that is, the rear chamber 9. The purpose of this chamber system 6 is to act in conjunction with the diaphragm 2 to restrict the vibration of the peripheral area 5 of the diaphragm 2 at times of high-frequency movement by the controller 3 and also to prevent the formation of constant reflections and resonances. Its restriction effect is achieved by slowing down the oscillating wave front and air flow created by the vibration of the diaphragm 2. To prevent formation of constant reflections and resonances the chamber walls are curved in shape. Oscillating wave fronts pass through the middle chamber 8 at times when the diaphragm 2 is vibrating, depending on the direction that the diaphragm is moving at a given instant. When the diaphragm 2 moves upwards, air flows from the rear chamber 9 via the middle chamber 8 into the front chamber 7, and the reverse occurs when the diaphragm moves downwards. The chamber system 6 is designed so that the route taken by the wave front and air flow from the rear chamber 9 to the lower part 5' of the periphery 5 of the diaphragm 2 is the longer one. This has the consequence that the periphery 5 is prevented from vibrating rapidly. In the case illustrated in FIG. 1 the chamber system 6 is symmetrical about the normal to the center point of the diaphragm 2, whereupon the chambers are arranged concentrically. The projection 14 extending from the edges of the loudspeaker casing to the central area 4 is bevelled on the side facing the front chamber 7. Therefore, the space 5' in the peripheral area 5 remaining below the rear surface 2" of the diaphragm 2 becomes narrower towards the edges of the loudspeaker casing 1. The length of the projection 14 is such that the distance (a) between its front edge and the center line of the loudspeaker casing 1 perpendicular to the diaphragm 2 is 0.4–0.7 r, for instance, where r is the distance of this center line from the edge of the diaphragm 2. Since the loudspeaker casing 1 is a solid unit, the chamber system 6 must be implemented by turning in a lathe, for example.

The middle chamber 8 is separated from the front and rear chambers 7 and 9 by the sound absorbing and/or air flow retarding dampers 10 and 11, such as layers of insulating material or the equivalent. The shapes of the parts functioning as the dampers 10 and 11 are determined so as to prevent their acoustic resonance from occurring at any constant frequency. The two dampers 10 and 11 can also be of different materials.

The external structure of the loudspeaker is presented in FIG. 3. The figure shows the areas 4 and 5 of the diaphragm. For aesthetic reasons the construction may also be rectangular in form, for instance.

A brief functional description of the vibration movements of the diaphragm at different frequencies is given below. When the voice coil 12 of the controller 3 conveys a high frequency vibration to the diaphragm 2, the latter begins to vibrate in those places where it is most flexible, that is, in the central area 4. In this case, the radiating surface is the central area 4 of the diaphragm 2, which broadcasts an essentially spherical sound wave to a certain sector. The spread of this high-frequency vibration to the peripheral area 5 is prevented not only by the increased rigidity of the diaphragm but also by the fact that the wave fronts and air flows of the chamber system effectively prevent vibration in the peripheral areas 5. As the frequency of vibration diminishes, a progressively larger proportion of the diaphragm 2 is involved in the vibration. This is enhanced by the fact that the effect of the chamber system 6 in suppressing vibrations in the diaphragm 2 is reduced and the fact that the period of the sound waves is longer at lower frequencies. In the course of one such vibrational movement, the central area 4 of the diaphragm first rises. This causes a spherical sector wave in the diaphragm 2 that advances at a given spatial radius. Since the sound wave radiation advances in a sector of a sphere but is generated in a plane, it does not arise over the whole surface of the sphere simultaneously but with a certain lag. This gives rise first to vibration in the central area 4 and then to a vibration stage affecting the area outside. The result is that a sound wave is generated in the outermost parts of the diaphragm after a certain delay. In other words, a low-frequency sound is produced for a longer time than its periodicity would warrant. The mass of the diaphragm 2 must increase as a function of radius, so that the higher frequencies will advance less the higher they are. Since the loudspeaker also contains the chamber system 6, the wave front and air flows taking place in the loudspeaker casing should be added to the vibration of the diaphragm 2 in the loudspeaker casing 1 as described above. The loudspeaker according to the invention can be tuned either mechanically or electronically. Mechanical tuning may take the form of painting a stripe at a certain point on the diaphragm 2 or a corresponding increase in mass or thinning that affects the vibrational properties of the diaphragm and, thereby, the quality of reproduction in a given frequency range.

The invention is not restricted to the above embodiment but can be varied within the limits of the accompanying claims. Thus, thinning of the diaphragm may be supplemented or entirely replaced by stiffeners attached to it, for example, or by thicker points, or the like, by which the elasticity or flexibility of the various parts of the diaphragm can be affected. The rigidity of the diaphragm increases outwards from the central area and its flexural rigidity in general is greater in a radial direction than perpendicular to this. Thus, the rigidity of an elongated diaphragm element at a given point on the diaphragm is different in a radial direction from what it is in a direction perpendicular to this. This difference should disappear at a regular rate towards the central area. Therefore, the rigidity of the central area is essentially independent of direction, that is, isotropic. This structure can conveniently be implemented by radial stiffeners or grooves on the rear surface of the diaphragm, for example. These could be fibers, grooves, slits or holes, etc. The diaphragm could also be of a sectoral or laminated construction. The diaphragm can also be of a porous material with the necessary directional rigidity. The grooves could also be circular, especially in the peripheral areas.

The rear surface of the diaphragm could possess a system of radial grooves of width 0.1–2 mm, for example, extending outwardly from close to the thin central area and continuing to the edge of the diaphragm or close to this. The depth of these grooves could set out from zero close to the center and increase towards the edge to reach as much as 95% of the thickness of the diaphragm. These grooves could also begin to curve progressively once they pass beyond the medium frequency reproduction area until they are running almost parallel to the edge of the diaphragm by the time they are near to it. The width of the grooves can also be adjusted to vary with the radius of the diaphragm or with the reproduction area.

The diaphragm 2 can also be grooved on both sides 2' and 2", with the grooves either coinciding on the two sides or, alternately, on one side or the other. Alternate grooves have the effect of making the imaginary rings running round the diaphragm elastic, allowing more transverse displacement in the diaphragm for the same voice coil power, thus emphasizing the lower frequency range. At the same time transverse rigidity is preserved by virtue of the radial direction of the grooves. The grooves themselves may also be circular, running round the diaphragm, especially in the peripheral areas. They provide the advantage that the diaphragm can move at low power, since it stretches at its edges, as it were. This will again improve sound reproduction, that is, sensitivity, at low frequencies. This is of particular importance if good bass reproduction is required with a small loudspeaker. These grooves can be produced at the casting or working stage or by corrosion or etching methods. In the case of a carbon fiber diaphragm, functionally, the same effect can be achieved by altering the properties of the composite so that the material equivalent in position to the grooves is elastic, but only in a certain direction.

The purpose of the grooves is that the same electric power in the voice coil should create a greater deflection in the diaphragm because the circular rigidity of the diaphragm, that is, that operating in a direction perpendicular to the radii of the diaphragm, is reduced. Rigidity in this direction increases the power needed to achieve a deflection in the diaphragm.

I claim:

1. A loudspeaker, comprising:

a case including an inner wall, a front opening, and an edge surrounding said front opening;

a diaphragm including a substantially planar front surface, a rear surface, and a periphery;

flexible attachment means for attaching said periphery of said diaphragm to said case in the vicinity of said edge of said front opening;

a controller attached to said case in the vicinity of a central portion of said inner wall of said case; and an actuator attached to said diaphragm in the vicinity of a central portion of said diaphragm;

wherein said controller and said actuator transform an electric signal provided to said controller into a corresponding vibratory movement of said diaphragm between a high frequency and a low frequency; said diaphragm includes a first area in the vicinity of where said actuator is attached to said diaphragm, and a second area between said first area and said periphery of said diaphragm; and said first area being of lighter weight and more elastic or flexible than said second area to make said diaphragm capable of sensitively vibrating only in said first area at frequencies being close to said high frequency, and to make said first area capable of transmitting to said second area vibratory movement of the actuator at frequencies close to said low frequency, and wherein said rear surface of said diaphragm includes grooves that extend radially from an area in the vicinity of said central portion of said diaphragm.

2. A loudspeaker according to claim 1, wherein said diaphragm is less than 2 mm thick.

3. A loudspeaker according to claim 1, wherein said actuator is a voice coil.

4. A loudspeaker according to claim 3, wherein said voice coil is integral with said diaphragm.

5. A loudspeaker according to claim 1, further comprising plurality of chambers constituting a chamber system and damping means provided between said chambers.

6. A loudspeaker, comprising:

a case including an inner wall, a front opening, and an edge surrounding said front opening;

a diaphragm including a substantially planar front surface, a rear surface, and a periphery;

flexible attachment means for attaching said periphery of said diaphragm to said case in the vicinity of said edge of said front opening;

a controller attached to said case in the vicinity of a central portion of said inner wall of said case; and an actuator attached to said diaphragm in the vicinity of a central portion of said diaphragm;

wherein said controller and said actuator transform an electric signal provided to said controller into a corresponding vibratory movement of said diaphragm between a high frequency and a low frequency; said diaphragm includes a first area in the vicinity of where said actuator is attached to said diaphragm, and a second area between said first area and said periphery of said diaphragm; and said first area being of lighter weight and more elastic or flexible than said second area to make said diaphragm capable of sensitively vibrating only in said first area at frequencies being close to said high frequency, and to make said first area capable of transmitting to said second area vibratory movement of the actuator at frequencies close to said low frequency and wherein said rear surface of said diaphragm includes grooves that extend radially from an area in the vicinity of said central portion of said diaphragm, and wherein said inner wall of said case and said rear surface of said diaphragm define a plurality of chambers constituting a chamber system, said loudspeaker further comprising means associated with said chamber system for retarding air flow within said chambers and for dampening vibration of said diaphragm at frequencies close to said high frequency.

7. A loudspeaker according to claim 6, wherein said plurality of chambers of said chamber system are separated by dampening means, and wherein at least one of said chamber system and said dampening means constitute said means for retarding air flow created by vibration of the diaphragm and dampening vibration of said diaphragm during diaphragm movements at frequencies close to said high frequency.

8. A loudspeaker according to claim 6, further comprising:

an outer wall of said case, said outer wall being located at a distance from said diaphragm;

a first, front chamber; and a second, middle chamber;

wherein said first, front chamber is defined between said rear surface of said diaphragm and said outer wall, and wherein said second chamber is located in the vicinity of said central portion of said inner wall of said case at a greater distance from said diaphragm than said first, front chamber and wherein said front and middle chamber are separated by a first aperture.

9. A loudspeaker according to claim 8, further comprising:

a third rear chamber defined by said inner wall of said case and located outwardly to said second middle chamber; and a second aperture located between said second chamber and said third chamber.

10. A loudspeaker according to claim 8, wherein said damping means is provided in at least one of said first aperture and said second aperture separating said middle chamber from said front and rear chambers respectively.

11. A loudspeaker according to claim 9, wherein walls of said chambers are curved in shape to prevent reflection of sound and acoustic resonance.

12. A loudspeaker according to claim 6, wherein said first area of said diaphragm is thinner than said second area of said diaphragm.

13. A loudspeaker according to claim 6, wherein said diaphragm is less than 2 mm thick.

14. A loudspeaker according to claim 8, wherein said distance between said outer wall and said diaphragm increases as a distance of said outer wall away from said inner wall of said case increases.

15. A loudspeaker according to claim 6, wherein said chambers have curved walls.

* * * * *